US010364094B2

(12) United States Patent
Carlson

(10) Patent No.: US 10,364,094 B2
(45) Date of Patent: Jul. 30, 2019

(54) STORING DEVICE FOR NEEDLEWORK CIRCULARS

(71) Applicant: Claudia Carlson, Descanso, CA (US)

(72) Inventor: Claudia Carlson, Descanso, CA (US)

( * ) Notice: Subject to any disclaimer, the term of this patent is extended or adjusted under 35 U.S.C. 154(b) by 0 days.

(21) Appl. No.: 16/037,903

(22) Filed: Jul. 17, 2018

(65) Prior Publication Data

US 2019/0023481 A1 Jan. 24, 2019

Related U.S. Application Data

(60) Provisional application No. 62/534,132, filed on Jul. 18, 2017.

(51) Int. Cl.

| | |
|---|---|
| ***B65D 85/67*** | (2006.01) |
| ***B65D 85/24*** | (2006.01) |
| ***D04B 3/02*** | (2006.01) |
| *B65D 43/02* | (2006.01) |

(52) U.S. Cl.

CPC ..... *B65D 85/24* (2013.01); *D04B 3/02* (2013.01); *B65D 43/0222* (2013.01)

(58) Field of Classification Search

CPC ..... B65D 85/67; B65D 85/66; B65D 85/04; B65D 85/02; B65D 85/00; B65D 85/24; A61M 5/002

USPC ..... 206/380

See application file for complete search history.

(56) References Cited

U.S. PATENT DOCUMENTS

| | | | | |
|---|---|---|---|---|
| 2,020,663 A * | 11/1935 | Stapleford | B65D 5/72 206/388 |
| 2,962,187 A * | 11/1960 | Morris | A01K 97/08 206/315.11 |
| 5,544,831 A * | 8/1996 | Van Netta | D05B 91/16 206/388 |
| 9,580,269 B2 * | 2/2017 | Quarandillo-Wold | B65H 49/08 |

* cited by examiner

*Primary Examiner* — King M Chu

(74) *Attorney, Agent, or Firm* — The Law Offices of Eric W. Peterson

(57) ABSTRACT

A needle storing device having a tube having a passageway, a first end and a second end, and a first cap having a top portion, a collar, a cavity, and an opening defined by a perimeter rim, wherein the tube is configured to receive at least one needlework circular, wherein the first cap engages the first end of the tube, wherein the collar of the first cap extends from the perimeter of the top portion of the first cap thereby defining the cavity of the first cap, and wherein the opening of the first cap is configured to receive a needlework circular.

8 Claims, 5 Drawing Sheets

STORING DEVICE FOR NEEDLEWORK CIRCULARS

CROSS-REFERENCE TO RELATED APPLICATION

This application claims the benefit of U.S. Provisional Application No. 62/534,132, filed on Jul. 18, 2017, which is incorporated herein by reference in its entirety.

BACKGROUND

Needlework is a method of manually manipulating thread or yarn to create cloth or other items and can include such methods as knitting, needlepoint, embroidery, crochet, or the like. Needlework tools such as circulars, needles, cables, hooks, or the like, aid the user in the manipulation of the thread, but challenges occur when storing the needlework tools and the needlework product. Often times, needlework tools are stored in a manner and location that renders them prone to damage. For example, needlework tools can become bent or broken if stored in a purse, bag, or box. In addition, when a user is interrupted prior to the completion of the needlework product and stores an uncompleted needlework product in a location such as a purse, portions of the needlework product can slide off the needlework tools causing the needlework product to unravel.

SUMMARY OF THE INVENTION

The present disclosure pertains to a needle storing device having a tube having a passageway, a first end and a second end, and a first cap having a top portion, a collar, a cavity, and an opening defined by a perimeter rim, wherein the tube is configured to receive a needlework circular, wherein the first cap engages the first end of the tube, wherein the collar of the first cap extends from the perimeter of the top portion of the first cap thereby defining the cavity of the first cap, and wherein the opening of the first cap is configured to receive the needlework circular.

One aspect of the disclosure is a needle storing device where the needlework circular comprises a needle and a cable, where the tube is configured to receive the entire length of the needle. Another aspect of the disclosure is a needle storing device where the perimeter rim of the first cap is configured to implement a bias on the needlework circular where the opening has received the needlework circular. Another aspect of the disclosure is a needle storing device where the opening of the first cap is configured to have a first distance where the opening has not received the needlework circular, a second distance where the opening has received the needlework circular, and wherein the second distance is greater than the first distance. Another aspect of the disclosure is a needle storing device where the first cap is fixedly engaged to the first end of the tube. Another aspect of the disclosure is a needle storing device where the tube is rigid. Another aspect of the disclosure is a needle storing device where the edge of the first end of the tube is chamfered.

Another aspect of the disclosure is a needle storing device where the top portion of the first cap has a shape substantially similar to the cross-sectional shape of the tube. Another aspect of the disclosure is a needle storing device further having a second cap having a top portion, a collar, a cavity, and an opening defined by a perimeter rim, wherein the second cap engages the second end of the tube, wherein the collar of the second cap extends from the perimeter of the top portion of the second cap thereby defining the cavity of the second cap, and wherein the opening of the second cap is configured to receive the needlework circular.

With those and other objects, advantages and features on the invention that may become hereinafter apparent, the nature of the invention may be more clearly understood by reference to the following detailed description of the invention, the appended claims, and the drawings attached hereto.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

The present disclosure pertains to a storing device 100 for storing needlework circulars used in needlework, for example, without limitation, tips and/or accompanying cables. Tips can be, for example, without limitation, needles used in knitting, hooks used in crochet, or the like. For exemplar purposes, a needle is used throughout this disclosure when referencing the needlework circulars. This example is not meant to limit the type of needlework circular to a needle, but is used to represent all types of needlework circular tools and components therein, for example, without limitation, tips and/or cables of a needlework circular used in knitting, crochet, or the like. The storing device 100 can be used to retain a needle 200 so to protect the needle 200, cable 300, and the needlework product 400 from becoming damaged. For example, without limitation, a needle 200, cable 300, and/or a portion of either can be retained within the storing device 100 to protect the needle 200, cable 300, and/or the connection joint between the needle 200 and cable 300, from becoming broken, bent, dented, or the like, and prevent the needlework product 400 from unraveling.

Figures 1, 2:
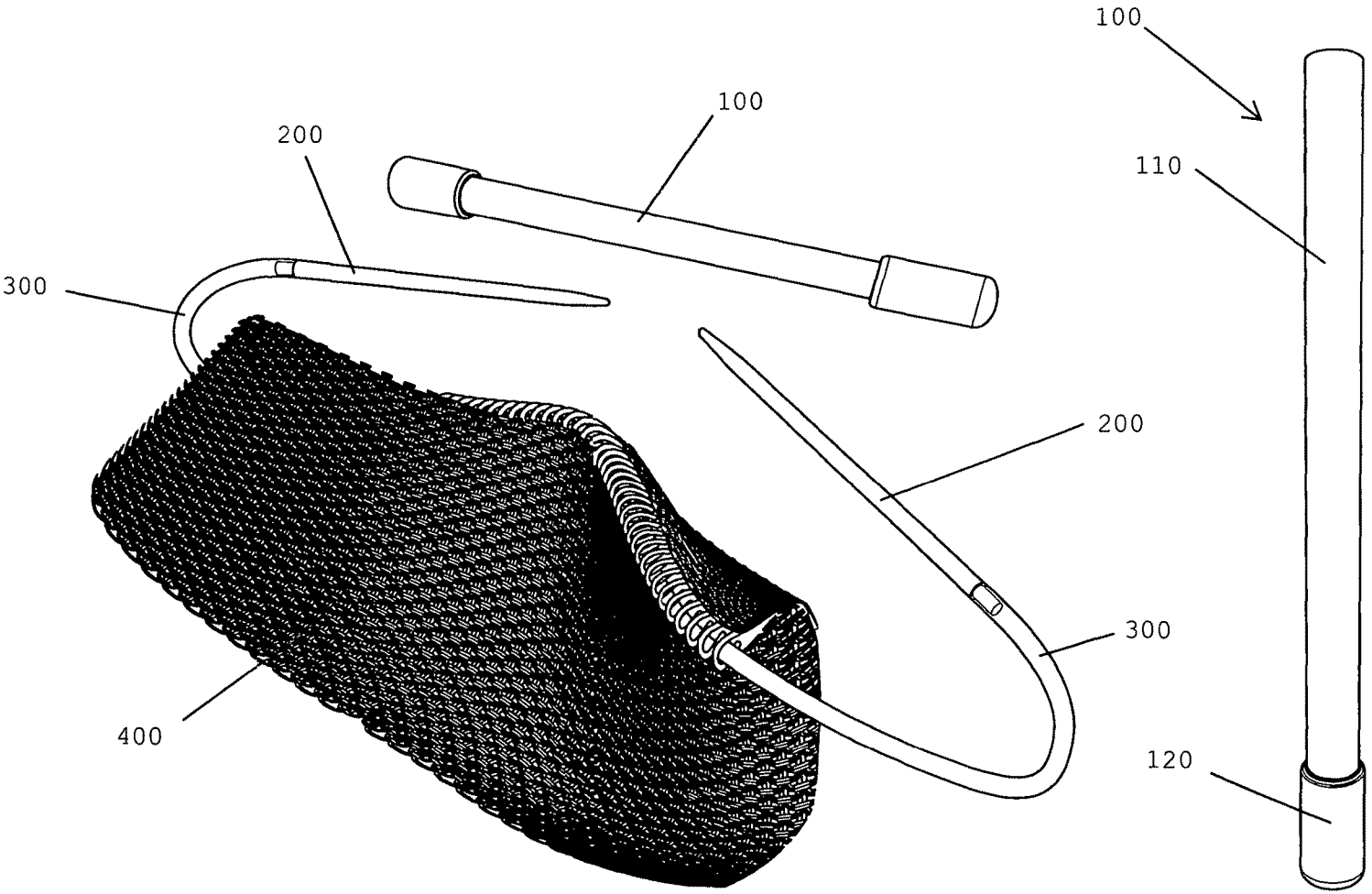
FIG. 1 is a perspective view of a storing device according to an exemplary embodiment.
FIG. 2 is a perspective view of a storing device according to an exemplary embodiment.
Figure 3:
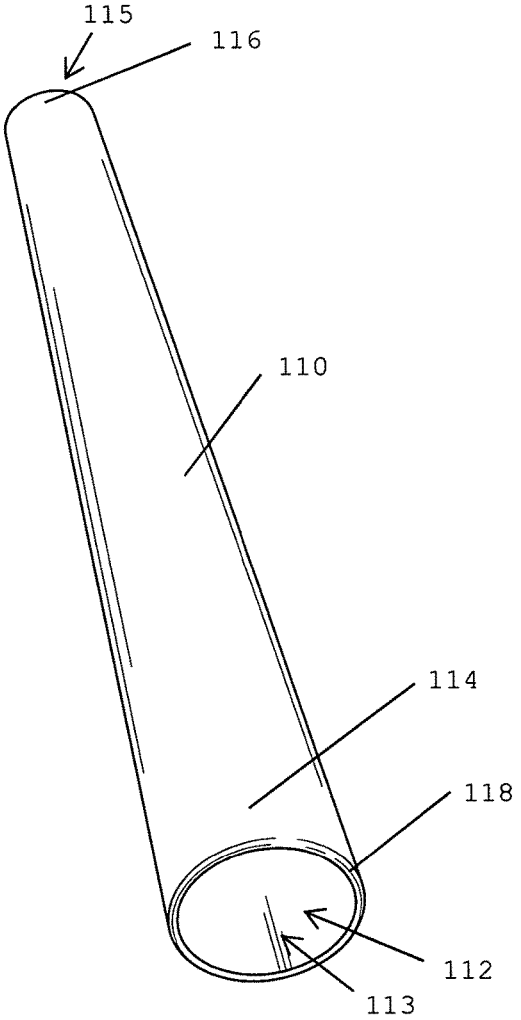
FIG. 3 is a perspective view of a tube according to an exemplary embodiment.

As shown in FIGS. 1 and 2, the storing device 100 can have a tube 110 and at least one cap 120. The tube 110 can be configured to receive at least one needle 200. As shown in FIG. 3, the tube 110 can have a passageway 112, a first opening 113 at the first end 114, and a second opening 115 at the second end 116, wherein the first opening 113 and second opening 115 lead to the passageway 112. In one embodiment, the first and second opening 113,115 are configured to receive at least on needle 200. The tube 110 can have any cross-sectional shape without altering the effect of the tube 110, for example, without limitation, circular, oval, square, triangular, or the like. The tube 110 can be made of any rigid material, for example, without limitation, metal, wood, polymer, or the like. The rigidity of the tube 110 allows for the tube 110 to prevent or reduce damage to the needle 200. The edge 118 of the end 114,116 of the tube 110 can be chamfered, rounded, beveled, or the like. The chamfered edge 118 prevents damage to the knitting material, such as yarn, threads, fibers, or the like, from snagging on the edge 118 of the end 114,116 of the tube 110, damage to the knitting, damage to the knitted project, injury to the knitter, or the like.

Figure 4:
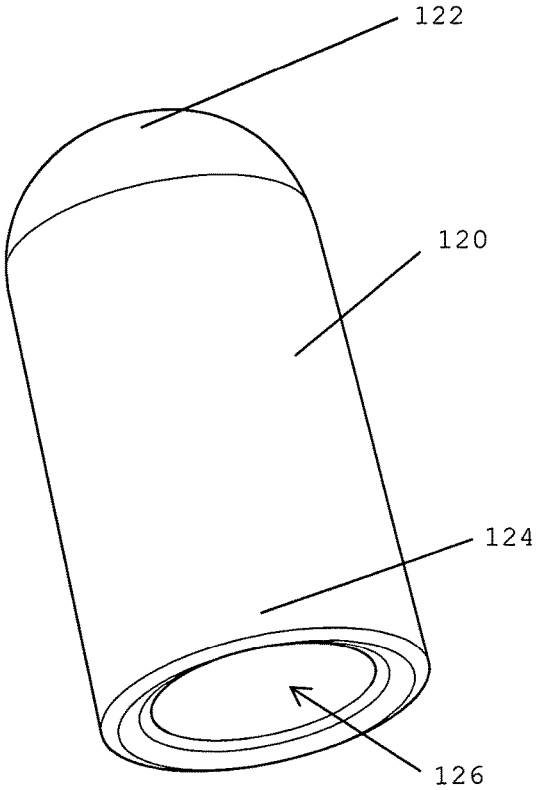
FIG. 4 is a perspective view of a cap according to an exemplary embodiment.

As shown in FIG. 4, the cap 120 can have a top portion 122 and a collar 124 extending from the perimeter of the top portion 122 whereby the top portion 122 and collar 124 define a cavity 126. The cap 120 is configured to be positioned at an end 114,116 of the tube 110 with the cavity 126 configured to receive the end 114,116 of the tube 110. The top portion 122 can have a shape substantially similar to the cross-sectional shape of the tube 110. For example, without limitation, where the tube 110 has a circular cross-sectional shape, the top portion 122 has a circular shape. In one embodiment, the storing device 100 can have two caps 120, where a first cap 120 can engage a first end 114 of the tube 110 and a second cap 120 can engage a second end 116 of the tube 110. The cap 120 can fixedly or releaseably engage the end 114,116 of tube 110. The cap 120 can be made of any semi-rigid material, for example, without limitation, PVC, silicone, ABS, plastic, or the like. The cross-sectional shape of the cap 120 can correspond to the cross-sectional shape of the tube 110, for example, without limitation, where the tube 110 has a cross-sectional cylindrical shape, the cap 120 has a cross-sectional cylindrical shape. The cross-sectional radius to the inside surface of the cap 120 can be substantially similar to the cross-sectional radius to the exterior surface of the tube 110 thereby allowing for the inside surface of the collar 124 to tightly matte with the exterior surface of the end 114,116 of the tube 110.

The cap 120 can have an opening 130 configured to receive at least one needle 200, where the opening 130 is defined by a perimeter rim 132. The opening 130 can be positioned within the top portion 122 of the cap 120. The opening 130 can be any size or shape capable of receiving a needle 200, for example, without limitation, the opening 130 can be circular, oval, longitudinal like a slit, or the like.

Figure 5:
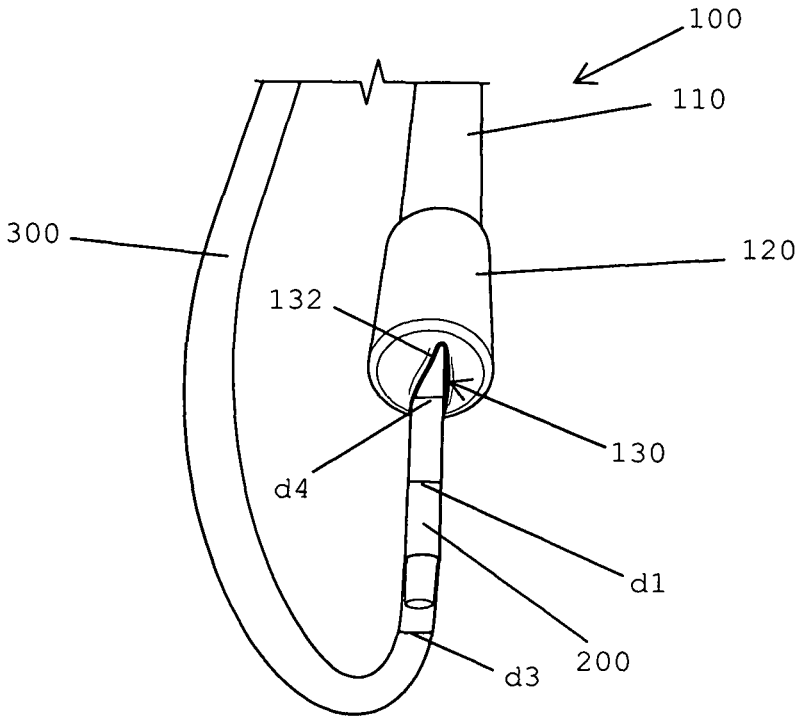
FIG. 5 is a perspective view of a storing device according to an exemplary embodiment.
Figure 6:
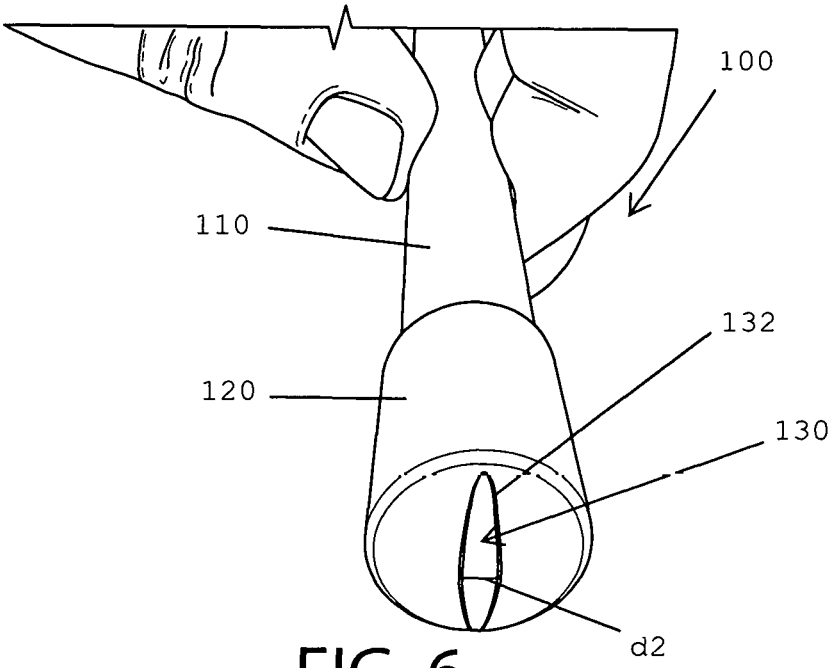
FIG. 6 is a perspective view of a storing device according to an exemplary embodiment.

In one embodiment, the opening 130 can be any size or shape that results in a bias or compression of the perimeter rim 132 of the opening 130 when at least one needle 200 is inserted into the opening 130. As shown in FIG. 5, the bias of the perimeter rim 132 of the opening 130 can apply a force onto a needle 200 and/or the cable 300, thereby slideably or releaseably securing the needle 200 and/or the cable 300 within the opening 130. In one embodiment, the perimeter rim 132 is capable of stretching, thereby enlarging the opening 130. As shown in FIGS. 5 and 6, by the opening 130 receiving the needle 200 and/or the cable 300, the needle 200 and/or the cable 300 enlarges the opening 130 by stretching the perimeter rim 132. Upon the stretching of the perimeter rim 132, the perimeter rim 132 can apply a bias, for example, without limitation, a radial force onto the needle 200 and/or the cable 300. In one embodiment, the bias is created by the opening 130 being smaller than the cross-section of the needle 200 and/or the cable 300, i.e. the distance d2 across the opening 130 can be less than the distance d1 of the cross-sectional diameter of the needle 200 measured to the exterior surface of the needle 200 and/or less than the distance d3 of the cross-sectional diameter of the cable 300 measured to the exterior surface of the cable 300. For example, without limitation, as shown in FIGS. 5 & 6, where the opening 130 is a slit, the distance d1 is greater than the distance d2. By way of another example, without limitation, where the opening 130 has a circular shape, the diameter of the opening 130 is less than the cross-sectional diameter of the needle 200 measured to the exterior surface of the needle 200 and/or less than the cross-sectional diameter of the cable 300 measured to the exterior surface of the cable 300. Stated another way, the opening 130 of the cap 120 is configured to have a first distance d2 where the opening 130 has not received the needle 200, a second distance d4 where the opening 130 has received the needle 200, and wherein the second distance d4 is greater than the first distance d2. In one embodiment, the opening 130 can be any size or shape that results in a bias of the perimeter rim 132 of the opening 130 onto at least two portions of the needle 200 and/or cable 300. For example, without limitation, where a first portion of the needle 200 has a greater cross-sectional radius than the cross-sectional radius of a second portion of the needle 200, the perimeter rim 132 of the opening 130 is configured to apply a force to the first portion and second portion of the needle 200 and/or cable 300.

Figure 8:
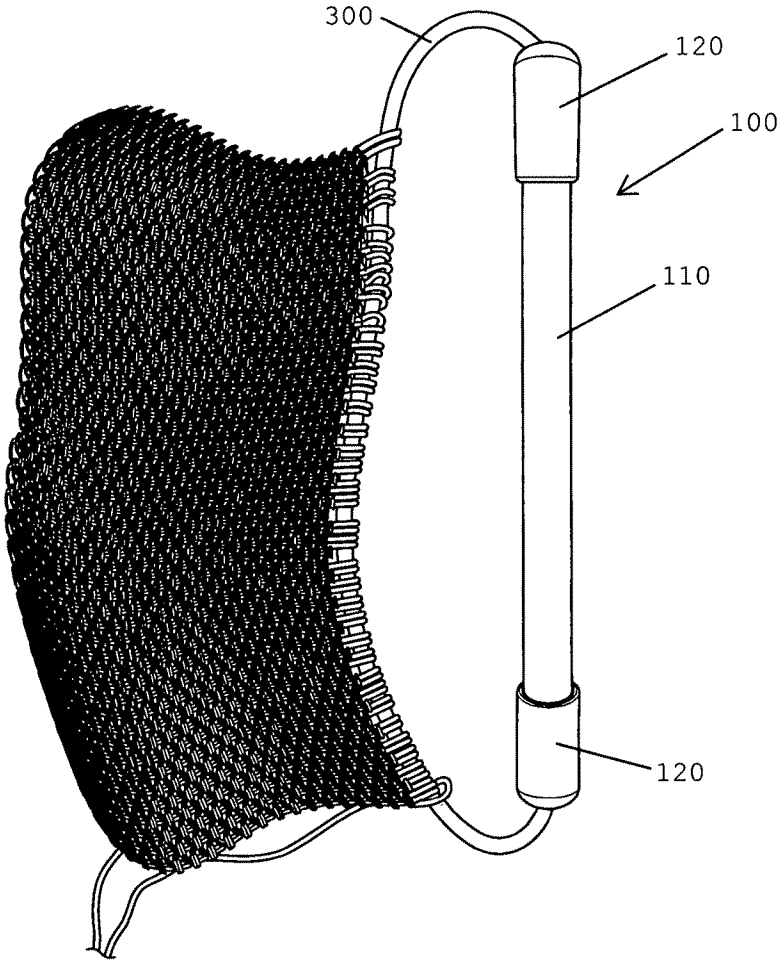
FIG. 8 is a perspective view of a storing device according to an exemplary embodiment.
Figure 7:
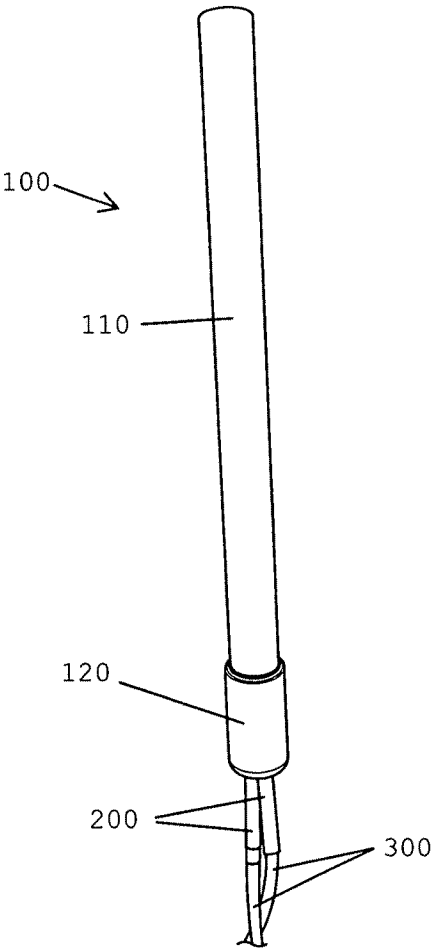
FIG. 7 is a perspective view of a storing device according to an exemplary embodiment.
Figure 9:
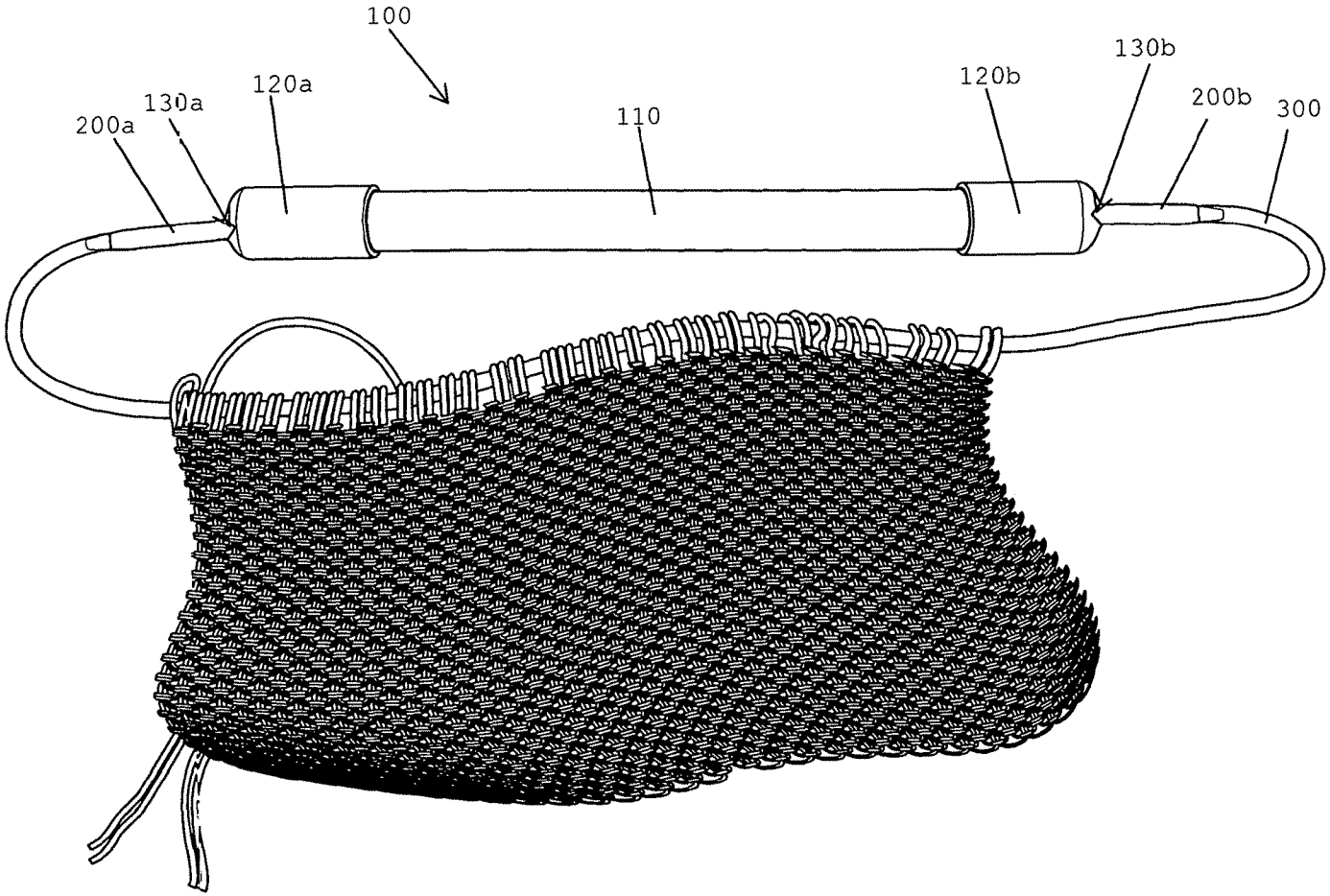
FIG. 9 is a perspective view of a storing device according to an exemplary embodiment.

In one embodiment, a needle 200 is inserted into the opening 130 of the cap 120 and into the passageway 112 of a tube 110 until the needle 200 is positioned at a desired depth into the opening 130. For example, without limitation, as shown in FIG. 7, the needle 200 can be inserted into the opening 130 at a depth where a portion of the needle 200 remains exterior to the storing device 100. By way of another example, without limitation, as shown in FIG. 8, the entire length of the needle 200 and a portion of the cable 300 is inserted into the opening 130 at a depth where a portion of the cable 300 remains exterior to the storing device 100. In another embodiment, as shown in FIG. 7, two needles 200 are inserted into the opening 130 of the cap 120. In another embodiment, as shown in FIGS. 8 & 9, a first needle 200*a* is inserted into a first opening 130*a* of a first cap 120*a* and a second needle 200*b* is inserted into a second opening 130*b* of a second cap 120*b*.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. A needle storing device comprising:

a tube having a passageway, a first end and a second end, and a first cap having a top surface, a collar, a cavity, and an opening defined by a perimeter rim, wherein the tube is configured to receive a needlework circular, wherein the first cap engages the first end of the tube, wherein the opening of the first cap is positioned within the top surface, wherein the collar of the first cap engages the top surface and extends from the perimeter of the top portion of the first cap thereby defining the cavity of the first cap, wherein the opening of the first cap is configured to receive the needlework circular, and wherein the perimeter rim of the opening is configured to implement a compression force on the needlework circular thereby slideably securing the needlework circular within the opening.

2. A needle storing device of claim 1 wherein the needlework circular comprises a needle and cable, wherein the tube is configured to receive the entire length of the needle.

3. A needle storing device of claim 1 wherein the opening of the first cap is configured to have a first distance where the opening has not received the needlework circular, a second distance where the opening has received the needlework circular, and wherein the second distance is greater than the first distance.

4. A needle storing device of claim 1 wherein the first cap is fixedly engaged to the first end of the tube.

5. A needle storing device of claim 1 wherein the tube is rigid thereby reducing damage to the needlework circular.

6. A needle storing device of claim 1 wherein the edge of the first end of the tube is chamfered.

7. A needle storing device of claim 1 wherein the top portion of the first cap has a shape substantially similar to the cross-sectional shape of the tube.

8. A needle storing device of claim 1 further comprising:

a second cap having a top surface, a collar, a cavity, and an opening defined by a perimeter rim, wherein the second cap engages the second end of the tube, wherein the top surface of the second cap engages the collar of the second cap, wherein the collar of the second cap extends from the perimeter of the top portion of the second cap thereby defining the cavity of the second cap, wherein the opening of the second cap is positioned within the top surface of the second cap, and wherein the opening of the second cap is configured to receive the needlework circular.

* * * * *